US010458620B2

(12) United States Patent
Jauernig et al.

(10) Patent No.: US 10,458,620 B2
(45) Date of Patent: Oct. 29, 2019

(54) MOTOR VEHICLE LIGHTING DEVICE WITH A VENTILATING DEVICE

(71) Applicant: Automotive Lighting Reutlingen GmbH, Reutlingen (DE)

(72) Inventors: Peter Jauernig, Reutlingen (DE); Uwe Schubert, Plochingen (DE); Markus Kindler, Stuttgart (DE); Bernd Muehlbauer, Ostfildern (DE); Achim Bathe, Reutlingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 0 days.

(21) Appl. No.: 15/730,393

(22) Filed: Oct. 11, 2017

(65) Prior Publication Data

US 2018/0106457 A1 Apr. 19, 2018

(30) Foreign Application Priority Data

Oct. 13, 2016 (DE) ..... 10 2016 119 511

(51) Int. Cl.
*F21S 45/30* (2018.01)
*F21S 41/20* (2018.01)
*F21S 43/20* (2018.01)

(52) U.S. Cl.
CPC ..... *F21S 45/30* (2018.01); *F21S 41/28* (2018.01); *F21S 43/26* (2018.01)

(58) Field of Classification Search
CPC .. F21S 45/33; F21S 45/43; F21S 45/47; F21S 45/30
See application file for complete search history.

(56) References Cited

U.S. PATENT DOCUMENTS 4,755,917 A * 7/1988 Bals ..... F21S 45/33 362/547
6,071,000 A * 6/2000 Rapp ..... F21S 48/332 362/362
7,329,033 B2 * 2/2008 Glovatsky ..... B60Q 1/0052 362/547

(Continued)

FOREIGN PATENT DOCUMENTS

DE 202014008530 U1 1/2016
DE 102014113491 A1 3/2016

OTHER PUBLICATIONS

Search Report dated Jul. 13, 2017 for German Patent Application No. 10 2016 119 511.1.

*Primary Examiner* — Christopher Stanford
(74) *Attorney, Agent, or Firm* — Howard & Howard Attorneys PLLC

(57) ABSTRACT

A motor vehicle lighting device has a housing and a ventilating device with an air supply line, which has an air intake opening, and which tapers away from the air intake opening in the form of a funnel, and which has an air outlet opening. The ventilating device includes a water collecting chamber, into which the air supply line opens with a transition cross section, and which has a water discharge opening and an air outlet opening, wherein the water discharge opening is disposed lower than the air outlet opening in an intended use of the ventilating device in a motor vehicle. A clearance of the water collecting chamber lying between the transition cross section and the air outlet opening is greater than the transition cross section.

10 Claims, 3 Drawing Sheets

(56) References Cited

U.S. PATENT DOCUMENTS

| | | | | |
|---|---|---|---|---|
| 7,427,152 | B2 * | 9/2008 | Erion | F21S 41/147<br>362/547 |
| 2002/0181247 | A1 * | 12/2002 | Yamaguchi | B60Q 1/0088<br>362/547 |
| 2005/0157514 | A1 * | 7/2005 | Brinkmann | F21S 45/33<br>362/547 |
| 2013/0194818 | A1 * | 8/2013 | Gomez | F21S 45/49<br>362/547 |
| 2016/0084471 | A1 * | 3/2016 | Sander | F21S 45/43<br>362/547 |

* cited by examiner

MOTOR VEHICLE LIGHTING DEVICE WITH A VENTILATING DEVICE

CROSS-REFERENCE TO RELATED APPLICATIONS

The present application claims priority to and all the benefits of German Patent Application No. 10 2016 119 511.1, filed on Oct. 13, 2016, which is hereby expressly incorporated herein by reference in its entirety.

BACKGROUND OF THE INVENTION

1. Field of the Invention

The present invention relates to a motor vehicle lighting device.

2. Description of the Related Art

Such a motor vehicle lighting device is known from DE 20 2014 008 530. The known motor vehicle lighting device has a housing and a ventilating device with air supply line, which has an air intake opening and tapers away from the air intake opening in the manner of a funnel. The ventilating device also has an air outlet opening. Ventilating air exiting the air outlet opening of the ventilating device enters the housing of the motor vehicle lighting device.

Motor vehicle lighting devices are understood herein to be both headlamps as well as signal lights, in particular tail lights, but also separate front lights.

The ventilation and aeration of the motor vehicle lighting devices of motor vehicles serves to remove moisture from the interior of the motor vehicle lighting device. In particular on the inner surface of the cover plate, condensed water drops can be seen from the exterior as an unattractive haze. Some end customers assume wrongly that this is a defect and visit their dealers with complaints. Moisture is understood herein to be various states in which water is present in air. In practice, these are the vaporous state and the liquid state in the form of drops of different sizes.

The aeration and ventilation of the motor vehicle lighting device is intended to prevent the formation of such a haze, and to remove a nevertheless potentially existing haze. The known device already generates a driving wind powered ventilation volume flow, which results in a quick removal of condensed water droplets from motor vehicle lighting devices. In extreme conditions, such as strong rain and spray from vehicles in front, a reliable removal of the condensed water droplets is not always ensured.

SUMMARY OF THE INVENTION

Based on this, the object of the invention is to provide a motor vehicle lighting device that removes condensed water droplets at the start of travel in dry weather, as quickly as is the case in the prior art specified above, and with which no water droplets enter the motor vehicle lighting device, even in strong rain, at high speeds, and/or with strong spray.

According to these features, the ventilating device has a water collecting chamber, into which the air supply line opens with a transition cross section. The water collecting chamber has a water discharge opening and an air outlet opening, wherein the water discharge opening is disposed lower than the air outlet opening in an intended use of the ventilating device in a motor vehicle. A clearance of the water collecting chamber between the transition cross section and the air outlet opening is greater than the transition cross section.

An intended use is a use in which the motor vehicle lighting device is installed in the motor vehicle. Because the air supply line opens into the water collecting chamber with a transition cross section, the air entering the funnel-shaped, tapering air supply line, containing a great deal of water in extreme conditions, as is the case, for example, when driving through a great deal of spray, is conducted via the comparatively large air intake cross section of the ventilating device, exposed to the driving wind pressure buildup, into the water collecting chamber. Because of the funnel-shaped tapering, the airflow and the water droplets transported with the airflow are accelerated, which facilitates a separation of air and water droplets through subsequent direction changes. Because the water collecting chamber has a water discharge opening and an air outlet opening, wherein the water discharge opening is disposed lower than the air outlet opening in an intended use of the ventilating device in a motor vehicle, water can be removed from the airflow, and drained via the water discharge opening, such that this undesired water is not transported into the interior of the housing with the ventilation air. Because a clearance of the water collecting chamber lying between the transition cross section and the air outlet opening is greater than the transition cross section, the airflow is slowed, reducing an undesired transportation of water droplets. The larger clearance is accompanied by a cross section enlargement, which tends to lead to an expansion, and thus to a reduction in the air temperature, which facilitates in the removal of water droplets from the air.

One design is distinguished in that the air intake opening is lower than the transition cross section in an intended use of the motor vehicle lighting device.

As a result, an airflow and an air deflection, directed upward in part, is obtained, with which water can be separated from the airflow, because the heavier, and thus slower, water cannot follow the deflection as well as the air.

An upper edge of the air intake opening, in an intended use of the motor vehicle lighting device, may be lower than a lower edge of the transition cross section.

As a result, the airflow entering via the air intake opening cannot end up in the water collecting chamber without changing direction. The deflecting surface then acts as a water deflector plate, which the water that cannot follow the deflection strikes, due to its inertia. It loses its kinetic energy on impact, and drains in a direction determined by the shape of the deflecting surface. This water then does not end up in the housing of the motor vehicle lighting device.

Moreover, a height of the air intake opening lying parallel to a vehicle vertical axis in an intended use of the motor vehicle lighting device may be greater than a height of the transition cross section parallel thereto.

Another design is distinguished in that a width of the air intake opening lying parallel to a vehicle horizontal axis in an intended use of the motor vehicle lighting device is greater than a width of the transition cross section parallel thereto.

As a result of these size relationships, the transition cross section with which the air supply line opens into the water collecting chamber is smaller than the air intake cross section. This results in the effect specified above, of an acceleration of the air and the water droplets transported with the air, facilitating a separation of air and water droplets through the subsequent changes in direction.

An air filter may be disposed in a flow path of the air exiting via the air outlet opening, directly in front of or behind the air outlet opening. An entry of dust into the housing can be prevented with such an air filter. Due to the particularly effective ventilation of the housing by the invention, caused by a large, driving wind powered, ventilation flow, there is a greater dust accumulation in comparison with less effective ventilation, which, without countermeasures, could lead to an undesirably fast contamination of the housing interior. The specified positioning of the air filter represents an effective countermeasure. In a preferred design, the air filter can be replaced. It is also preferred that the air filter is water repellent.

The ventilating device may be an integral component of a housing of the motor vehicle lighting device, and the air outlet opening opens into an interior of the housing. This design has the advantage, in comparison with multi-part designs, of a simplified assembly.

In another embodiment, the ventilating device is a component releasably attached to a wall of the housing, and in that the air outlet opening opens into an interior space of the motor vehicle lighting device.

This design has the advantage of a less complicated production of the individual parts. The individual parts can be produced, for example, in a production through injection molding of plastic, with less complex injection molds in comparison with the design in which the ventilating device is integrated in the housing.

In another embodiment, a fine mesh is provided at the air intake opening, so that insects or larger particles of dirt cannot enter the ventilating device. The releasable attachment also simplifies a desired replacement of an air filter. This is of particular advantage when the motor vehicle is operated over greater distances in dusty conditions. A gradually clogging filter could then reduce the effectiveness of the ventilation and defrosting. This undesired result can be avoided with little effort, by replacing the air filter.

The ventilating device may be disposed in a motor vehicle, in the intended use of the motor vehicle lighting device, such that it is spatially separated from the housing, and such that the motor vehicle lighting device has an air conducting connecting line, which connects the air outlet opening of the ventilating device to an interior space of the housing. This design has the advantage that the ventilating device can be installed, for example, at a location where a particularly high pressure buildup exists in front of the air intake opening when driving, which improves the effectiveness of the ventilation. Another advantage is that better use can be made of a tight installation space in the motor vehicle.

The housing may have a ventilation air outlet opening, and that an air filter is disposed in a flow path of the air exiting via the ventilation air outlet opening, directly in front of or behind the ventilation air outlet opening. It has proven to be the case that with some motor vehicles and some driving speeds, a pressure difference may exist at the ventilation air outlet opening, due to driving wind turbulences, which allows ambient air to enter the housing via the ventilation air outlet opening. The (second) air filter disposed there effectively prevents a contamination of the interior of the housing by dust in this case.

Further advantages can be derived from the following description, the drawings, and the dependent Claims. It is understood that the features specified above and to be explained below can be used, not only in the respective given combinations, but also in other combinations or in and of themselves, without abandoning the scope of the present invention.

Exemplary embodiments of the invention are depicted in the drawings, and shall be explained in greater detail in the following description.

BRIEF DESCRIPTION OF THE DRAWINGS

Therein, schematically in each case.

Identical reference symbols in the various Figures indicate respective identical or at least comparable elements, in terms of their function.

DETAILED DESCRIPTION OF THE INVENTION

Figure 1:
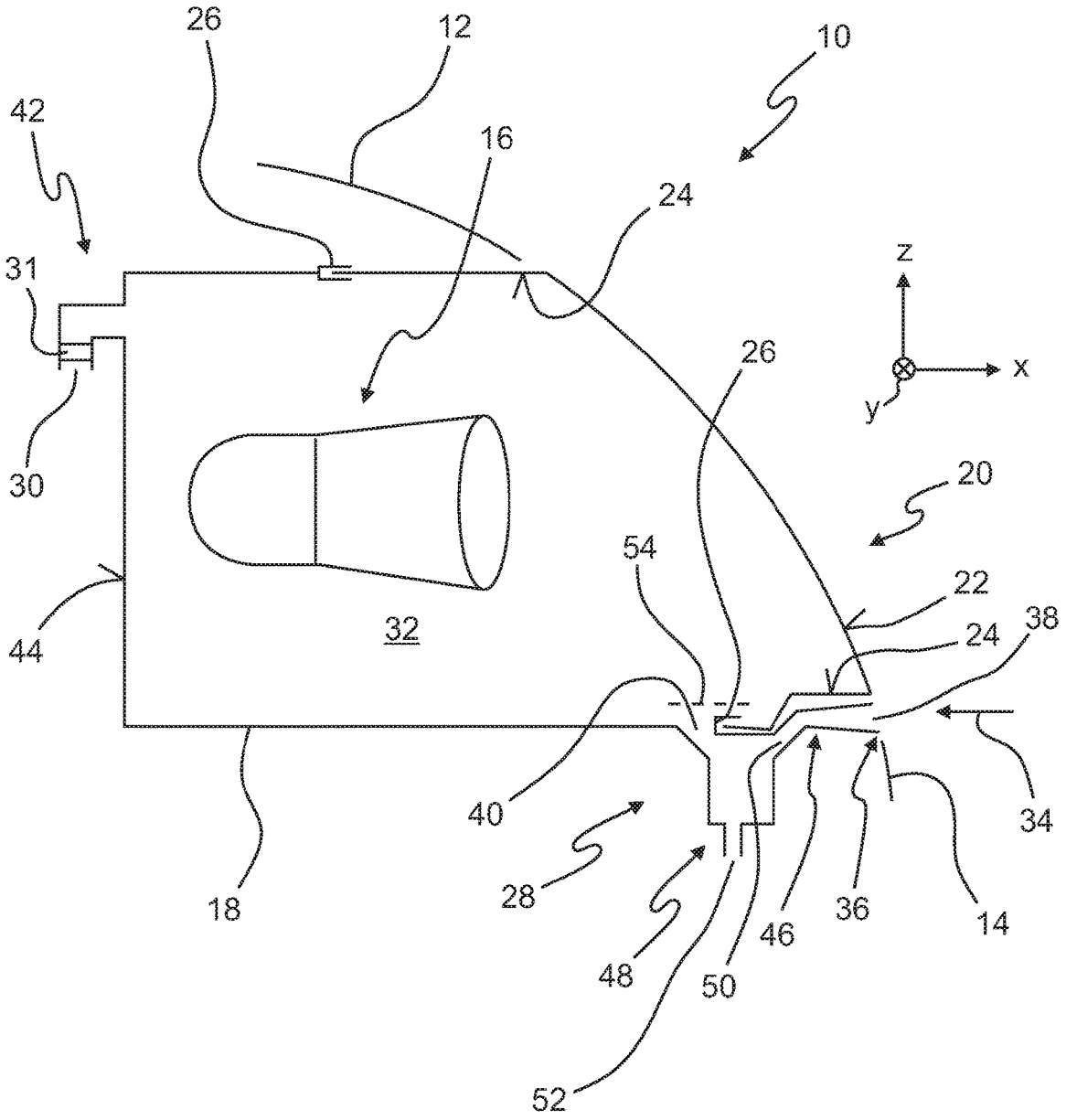
FIG. 1 shows a first exemplary embodiment in a vertical cross section.

In detail, FIG. 1 shows an assembly composed of a motor vehicle lighting device 10 and at least one bordering part 12, 14, in a vertical cross section.

The bordering parts 12, 14 are parts of the vehicle body, for example, or parts of an adjacent motor vehicle lighting device, which has its own housing, or a cooler of the motor vehicle bordering on the motor vehicle lighting device 10. The configuration depicted therein is obtained with an intended use of the motor vehicle lighting device 10, in which the motor vehicle lighting device 10 is installed in a motor vehicle.

The cutting plane of the vertical cross section is the x-y plane of a right-handed and right-angled coordinate system, the x-axis of which corresponds to the longitudinal axis of the vehicle, the y-axis of which is at a right angle thereto, and parallel to the horizontal, and the z-axis of which is at a right angle to the x-axis and the y-axis, and extends vertically upward. This directional convention for the x-axis is relevant in particular for headlamps and front lights. It shall be assumed in the following that the motor vehicle lighting device 10 is a headlamp. The invention is not limited to headlamps, however, but instead can also be implemented with front lights and taillights.

At least one light module 16 is disposed in the interior of the motor vehicle lighting device 10, which generates a light distribution complying with the regulations for motor vehicle lighting devices, whether this is a headlamp light distribution or a signal light distribution.

The motor vehicle lighting device 10 has a housing 18 and a transparent cover plate 20. The cover plate 20 is in the form of a shell, having a transparent base 22 and an edge 24 encompassing the base 22, protruding therefrom in the manner of a wall. The cover plate 20 covers the light exit opening 38 of the housing 18 with its transparent base 22. The edge 24 is received in a sealing bed 26 encompassing the light exit opening in the housing 18, and securely retained in a sealing manner in the sealing bed 26.

The motor vehicle lighting device 10 has a ventilating device 28 and a ventilation air outlet opening 30. The ventilating device 28 allows air to flow into an interior space 32 of the motor vehicle lighting device 10 delimited by the housing 18 and the cover plate 20. The ventilation air outlet opening 30 allows air to flow out of the interior space 32.

The ventilating device 28 is disposed externally, i.e. outside the interior space 32, on the housing 18, and is disposed to deflect ventilation air 36 into the interior space 32 of the motor vehicle lighting device 10 that flows along the exterior of the motor vehicle lighting device 10 through the effects of driving wind, in an intended use of the motor vehicle lighting device 10 in a moving motor vehicle.

The ventilation air 34 passes first through gaps 36 located between the motor vehicle lighting device 10 and the bordering parts 12, 14 encompassing the motor vehicle lighting device, into the body of the motor vehicle.

The ventilating device 28 causes the airflow to back up and generates a pressure buildup that is a function of the driving wind. The ventilating device 28 is located behind the gap 36, in the flow direction of the oncoming ventilation air 34, such that the pressure buildup is formed at an air intake opening 38 of the ventilating device 28. The air intake opening 38 is connected in an air-conducting manner to an air outlet opening 40 of the ventilating device 28 via the interior of the ventilating device, such that air entering the ventilating device 28 via the air intake opening 38 can exit the ventilating device 28 via the air outlet opening 40, and flow thereby into the interior space 32.

As a result of the pressure buildup, there is a pressure drop between the air intake opening 38 and the interior space 32, which deflects a portion of the outer oncoming air as ventilation air 34, and allows it to enter the interior space 32 through the ventilating device 28. In a preferred design, the ventilating device 28 is a materially bonded component of the housing 18 or the cover plate 20. In the depicted exemplary embodiment, the ventilating device 28 is a component of the housing 18. The ventilating device 28 is preferably made of the same material as the housing or the cover plate. It is thus composed, particularly preferably, of plastic, and is formed on the respective component during the injection molding of the housing or the cover plate.

The ventilation air outlet opening 30 is spatially distanced from the ventilating device 28, disposed in an outer wall of the housing 18. In the depicted design, the ventilation air outlet opening 30 is the flow cross section of a nozzle 42, which is disposed on a rear surface 44 of the housing 18 facing away from the light exit side of the housing 18, and which is curved or bent downward. The air flowing in through the ventilating device 28 absorbs moisture in the interior space 32 of the housing 18, and transports the absorbed moisture out of the housing 18 via the ventilation air outlet opening 30. In order to ensure such a flow-through, the ventilating device 28 and the ventilation air outlet opening 30 are disposed on walls of the motor vehicle lighting device 10 such that with an intended use in a motor vehicle, a greater air pressure exists under the influence of driving wind than in the ventilation air outlet opening 30.

In one embodiment, an air filter 31 is disposed in a flow path of the air exiting via the ventilation air outlet opening 30, directly in front of or behind the ventilation air outlet opening 30.

In the embodiment shown in FIG. 1, the ventilating device 28 is located in an intended use in a motor vehicle, there where it generates a pressure buildup in an airflow passing along the surface of the housing 18, generated by driving wind, and the ventilation air outlet opening 30 is located at a position where there is normally no pressure buildup, or at least only a lower pressure buildup, or even a suction.

In the embodiment shown in FIG. 1, the ventilating device 28 is transverse to a housing wall bordering the ventilating device 28, in the airflow, in the exterior on the sealing bed 26. With respect to the direction of the air flowing along the exterior of the housing, driven by the driving wind, the ventilating device 28 lies in the oncoming air. Because an air intake opening 38 of the ventilating device 28 is located on the sealing bed 26, there is the advantage of a particularly high pressure buildup. The pressure buildup is particularly high there, because the sealing bed 26 already extends outward into the airflow, such that a narrower flow cross section of the oncoming air exists there in comparison with the flow cross section resulting directly in front of the sealing bed 26 on the exterior of the motor vehicle lighting device 10.

The air intake opening 38 of the ventilating device 28, which lies in the gap 36, captures a portion of the air flowing along the exterior of the sealing bed 26, and redirects this portion, as ventilation air 34, through the ventilating device 28, into the interior space 32 of the housing 18.

The ventilating device 28 forms a flow obstruction with its air intake opening 38 lying transverse to the oncoming air. This pressure buildup results from this flow obstruction.

The ventilating device 28 has an air supply line 46, which forms the air intake opening 38 at one end. Starting from the air intake opening 38, the air supply line 46 tapers away from the air intake opening 38 in the manner of a funnel, and opens into a water collecting chamber 48. The air supply line 46 has a transition cross section 50 in the transition to the water collecting chamber 48. The water collecting chamber 48 has a water discharge opening 52 and the air outlet opening 40. The water discharge opening 52 is disposed lower than the air outlet opening 40 in an intended use of the ventilating device 28 in a motor vehicle. A clearance of the water collecting chamber 48 lying between the transition cross section 50 and the air outlet opening 40 is larger than the transition cross section 50.

The ventilating device 28 is an integral component of a housing 18 of the motor vehicle lighting device 10 in this design. The air outlet opening represents an air-conducting connection between the ventilating device 28 and the interior space 32 of the housing 18.

In this embodiment, the air intake opening 38 is higher than the transition cross section 50 in an intended use of the motor vehicle lighting device 10.

The ventilation air 34 flowing in via the air supply line 46 and containing moisture in unfavorable driving conditions is accelerated in the air supply line 46 tapering in the flow direction, and deflected at least once. In the exemplary embodiment depicted in FIG. 1, a deflection of the ventilation air 34 takes place prior to its entry into the water collecting chamber 48 via the transition cross section 50. The small water droplets are removed from the flow of the ventilation air 34 into the water collecting chamber 48 as a result of the deflection, e.g. through colliding with an inner wall of the ventilating device 28. The water is then drained from the water collecting chamber 48 via the water discharge opening 52.

The ventilation air 34 freed of the removed water enters the interior space 32 of the housing 18 via the air outlet opening 40 of the ventilating device 28, absorbs any moisture there, and transports this moisture out of the housing 18 via the ventilation air outlet opening 30.

In the embodiment depicted in FIG. 1, the ventilating device 38 is disposed below the housing 18. An air filter 54 can be disposed in the flow path of the air entering the housing 18 through the air outlet opening 40 of the ventilating device 28, which is disposed in the housing, for example, prior to the joining of the housing 18 and the cover plate 20, such that it covers the air outlet opening 40 of the ventilating device 28.

Figure 2:
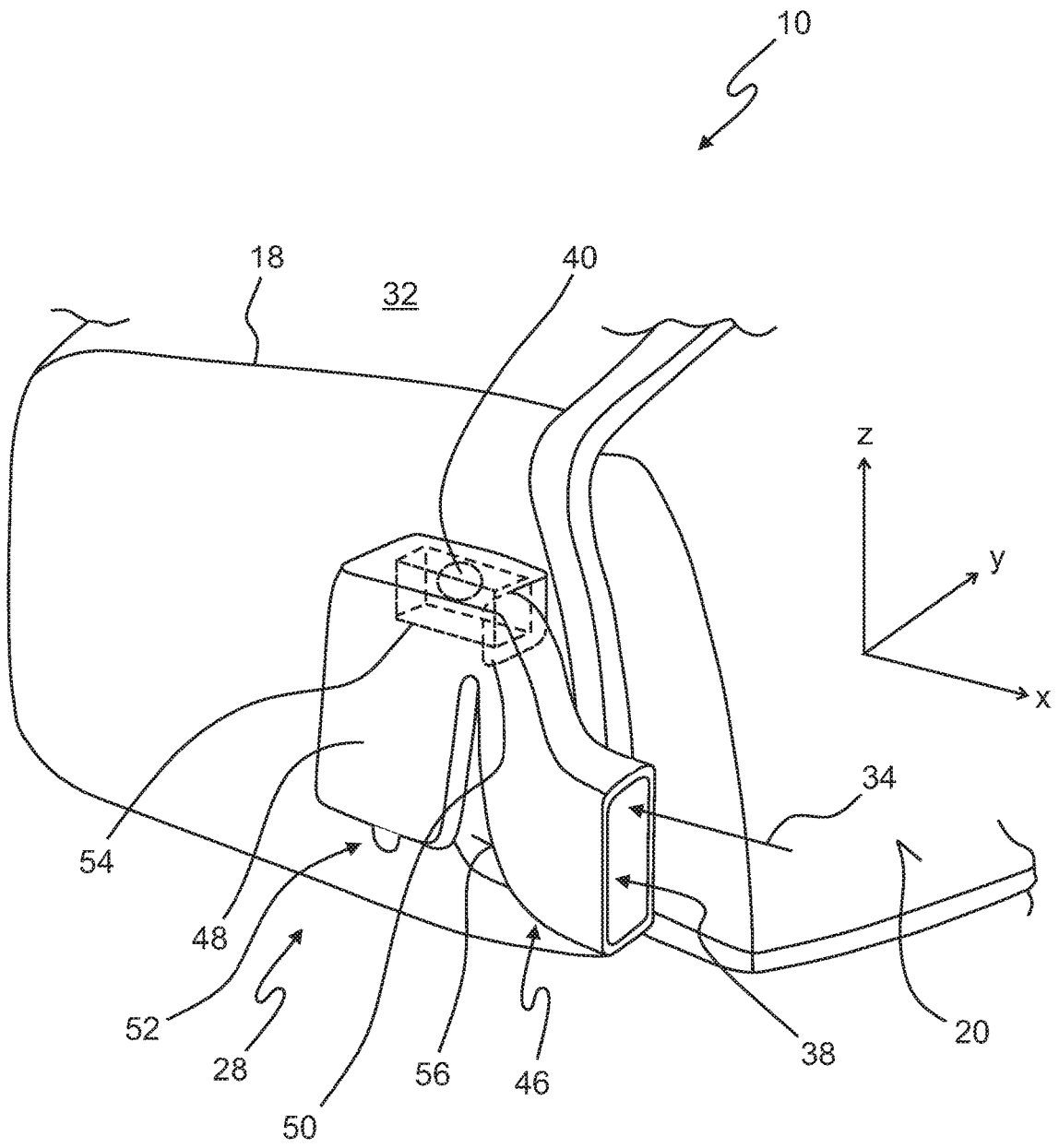
FIG. 2 shows a second exemplary embodiment in a diagonal view.

FIG. 2 shows an embodiment in which the ventilating device 28 is disposed on a right-hand side of a motor vehicle lighting device 10. The ventilating device 28 is a separate component thereby, which is releasably connected to the housing 18 of the motor vehicle lighting device 10. The releasable connection is preferably obtained via a flange, with screws or with a bayonet coupling, or a clip-connection. Tongues required for this can be easily produced from plastic through injection molding. The air outlet opening 40 of the ventilating device 28 opens into an interior space of the housing 18 of the motor vehicle lighting device 10. In another design, the ventilating device 28 depicted in FIG. 2 can be an integral component of a housing 18 of the motor vehicle lighting device 10, wherein the air outlet opening 40 then likewise opens into an interior space of the housing 18. A light exit opening of the housing 18 is covered by the transparent cover plate 20. The ventilating device 28 has an air supply line 46. The air supply line 46 has an air intake opening 38. In a headlamp serving as the motor vehicle lighting device 10, the air intake opening 38 is preferably transverse to the direction of travel, and when seen from the exterior, disposed behind a gap in the exterior shape of the motor vehicle, such that when the motor vehicle is driving, a pressure buildup is accumulated in front of the air intake opening 38.

The ventilating device 28 has a water collecting chamber 48, into which the air supply line 46 opens with a transition cross section 50, and which has one water discharge opening 52 and one air outlet opening 40. The air supply line 46 tapers in the form of a funnel away from the air intake opening 38. A height of the air intake opening 38 in an intended use of the ventilating device 28, parallel to a vehicle vertical axis, and thus to the z-axis, is greater than a parallel height of the transition cross section 50, with which the air supply line 46 opens into the water collecting chamber 48. It is also preferred that a width of the air intake opening 38 in an intended use of the ventilating device 28, which is parallel to a vehicle horizontal axis, and thus parallel to the y-axis, is greater than a parallel width of the transition cross section 50.

Ventilation air 34 can flow out of the water collecting chamber 48 into the interior of the housing 18 via the air outlet opening 40. The water collecting discharge opening 52 is also disposed lower than the air outlet opening 40 here, in an intended use of the ventilating device 28 in a motor vehicle. A clearance of the water collecting chamber 48 lying between the transition cross section 50 and the air outlet opening 40 is greater than the transition cross section 50.

In differing from the first exemplary embodiment, the air intake opening 38 is lower than the transition cross section 50 in an intended use of the motor vehicle lighting device 10. It is preferred thereby, that the upper edge of the air intake opening 38 is lower than a lower edge of the transition cross section.

The inner wall of the air supply line 46 lying opposite the air intake opening forms a deflecting surface 56 for water droplets flowing in with the ventilation air 34 via the air intake opening 38. A majority of these water droplets collide with this deflecting surface 56, run down the deflecting surface 56, and are drained off via the air intake opening 38. This water does not end up in this manner in the water collecting chamber 48. A water content remaining in the flow of the ventilation air 34 is removed from the airflow in the expansion of the flow of the ventilation air 34 at the transition through the comparatively narrow transition cross section 50 into the water collecting chamber 48, distinguished by a comparatively large clearance, and collects in the lower part of the water collecting chamber 48, and/or is drained off via the water discharge opening 52, preferably disposed at a lowest point in the water collecting chamber 48.

An air filter insert 54 is disposed in the flow path of the air flowing into the interior space of the housing 18 via the air outlet opening 40, in front of or behind the air outlet opening 40, which is retained there by retaining structures of the appropriate shape. The air filter insert 54 can be accessed when the ventilating device 28 is released from the housing 18, and can then be replaced. The air filter insert 54 is preferably made of a water-repellant material.

Figure 3:
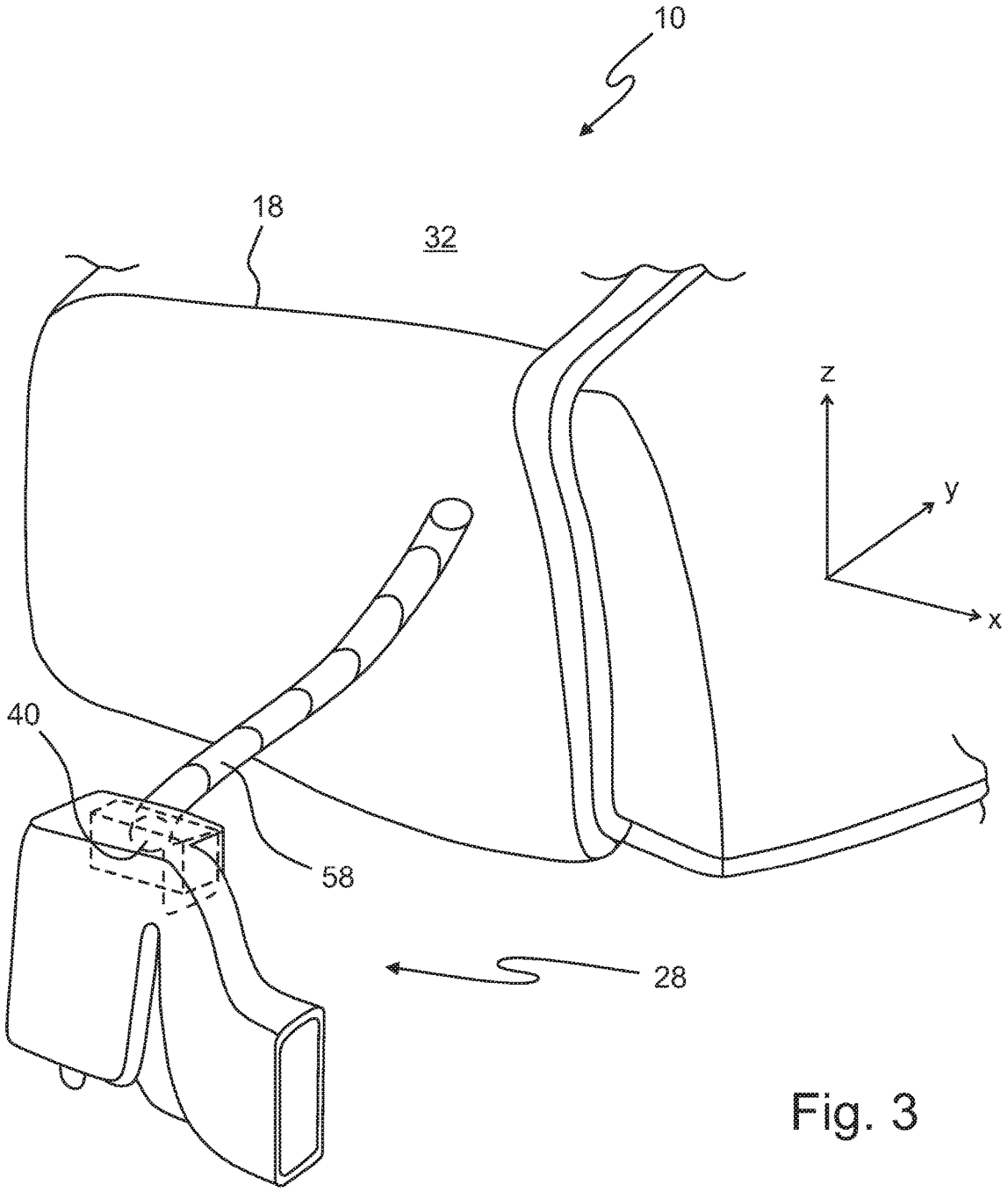
FIG. 3 shows a third exemplary embodiment in a diagonal view.

FIG. 3 shows another exemplary embodiment. In this exemplary embodiment, the ventilating device 28 is disposed spatially separated from the housing 32 in the intended use in a motor vehicle. The motor vehicle lighting device 10 has an air-conducting connecting line 58, which connects the air outlet opening 40 of the ventilating device 28 to an interior space 32 of the housing 18.

An optional air filter 54 is also disposed in this exemplary embodiment in a flow path of the air exiting via the air outlet opening 40, directly in front of or behind the air outlet opening 40 of the ventilating device 28.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A motor vehicle lighting device, which has a housing and a ventilating device with an air supply line and an air outlet opening, wherein the air supply line has an air intake opening, a transition cross-section, and an air outlet opening, wherein the transition cross-section tapers between the air intake opening and the air outlet opening, wherein the ventilating device has a water collecting chamber into which the air supply line opens, said water collecting chamber including a water discharge opening that is adjacent to the air outlet opening and the transition cross-section, wherein the water discharge opening is disposed lower than the air outlet opening when the ventilating device is mounted in a motor vehicle, and wherein the water collecting chamber is adjacent to a portion of the air supply line at which airflow accelerates through the air supply line due to tapering between the air intake opening and the transmission cross section.

2. The motor vehicle lighting device as set forth in claim 1, wherein the air intake opening is lower than the transition cross section in an intended use of the motor vehicle lighting device.

3. The motor vehicle lighting device as set forth in claim 2, wherein an upper edge of the air intake opening is lower than a lower edge of the transition cross section in an intended use of the motor vehicle lighting device.

4. The motor vehicle lighting device as set forth in claim 1, wherein a height of the air intake opening parallel to a vehicle vertical axis is greater than a parallel height of the transition cross section in the intended use of the motor vehicle lighting device.

5. The motor vehicle lighting device as set forth in claim 1, wherein a width of the air intake opening parallel to a vehicle horizontal axis is greater than a parallel width of the transition cross section in the intended use of the motor vehicle lighting device.

6. The motor vehicle lighting device as set forth in claim 1, wherein an air filter is disposed in a flow path of the air exiting via the air outlet opening, in front of or behind the air outlet opening.

7. The motor vehicle lighting device as set forth in claim 1, wherein the ventilating device is an integral component of a housing of the motor vehicle lighting device, and the air outlet opening opens into an interior space of the housing.

8. The motor vehicle lighting device as set forth in claim 1, wherein the ventilating device is a component releasably attached to a wall of the housing, and wherein the air outlet opening opens into an interior space of the motor vehicle lighting device.

9. The motor vehicle lighting device as set forth in claim 1, wherein the ventilating device is disposed spatially separated from the housing in the intended use of the motor vehicle lighting device, and wherein the motor vehicle lighting device has an air-conducting connecting line, which connects the air outlet opening of the ventilating device to an interior of the housing.

10. The motor vehicle lighting device as set forth in claim 1, wherein the housing has a ventilation air outlet opening, and wherein an air filter is disposed in a flow path of the air exiting via the ventilation air outlet opening, directly in front of or behind the ventilation air outlet opening.

* * * * *